US011725649B2

(12) United States Patent
Zhao

(10) Patent No.: US 11,725,649 B2
(45) Date of Patent: Aug. 15, 2023

(54) PUMP ASSEMBLY AND HIGH-PRESSURE CLEANING APPARATUS

(71) Applicant: Globe (Jiangsu) Co., Ltd, Jiangsu (CN)

(72) Inventor: Chunlin Zhao, Jiangsu (CN)

(73) Assignee: Globe (Jiangsu) Co., Ltd, Changzhou (CN)

( * ) Notice: Subject to any disclaimer, the term of this patent is extended or adjusted under 35 U.S.C. 154(b) by 23 days.

(21) Appl. No.: 17/084,202

(22) Filed: Oct. 29, 2020

(65) Prior Publication Data

US 2021/0138511 A1 May 13, 2021

(30) Foreign Application Priority Data

Nov. 11, 2019 (CN) ..... 201911094808.X

(51) Int. Cl.

| | |
|---|---|
| ***F04B 53/08*** | (2006.01) |
| ***F04B 17/03*** | (2006.01) |
| ***F04B 39/06*** | (2006.01) |
| ***F04B 9/04*** | (2006.01) |
| ***F04B 19/22*** | (2006.01) |
| ***F04B 53/16*** | (2006.01) |
| ***B08B 3/02*** | (2006.01) |

(52) U.S. Cl.

CPC ..... *F04B 53/08* (2013.01); *F04B 9/045* (2013.01); *F04B 17/03* (2013.01); *F04B 19/22* (2013.01); *F04B 39/064* (2013.01); *F04B 53/16* (2013.01); *B08B 3/026* (2013.01); *B08B 2203/027* (2013.01); *B08B 2203/0223* (2013.01)

(58) Field of Classification Search

CPC ..... F04B 9/045; F04B 17/03; F04B 19/22; F04B 39/064; F04B 53/08; F04B 53/143; F04B 53/16

USPC ..... 417/366–371

See application file for complete search history.

(56) References Cited

U.S. PATENT DOCUMENTS

| | | | | |
|---|---|---|---|---|
| 3,525,001 | A * | 8/1970 | Erickson | H02K 9/19 310/59 |
| 6,592,336 | B1 * | 7/2003 | Hirano | F04B 17/03 417/372 |
| 2010/0047091 | A1 | 2/2010 | Schiffhauer et al. | |
| 2012/0034111 | A1 | 2/2012 | Schiffhauer et al. | |
| 2013/0263899 | A1 | 10/2013 | Dirnberger et al. | |
| 2014/0154112 | A1 | 6/2014 | Nathan et al. | |
| 2016/0151133 | A1 * | 6/2016 | Luettgen | F04B 17/03 433/80 |

FOREIGN PATENT DOCUMENTS

| | | | | |
|---|---|---|---|---|
| CN | 103946544 | A * | 7/2014 | A61B 17/8822 |
| CN | 110052342 | A * | 7/2019 | B05B 9/0861 |

(Continued)

OTHER PUBLICATIONS

Extended Search Report of Counterpart European Patent Application No. 20206476.2 dated Feb. 17, 2021.

*Primary Examiner* — Alexander B Comley

(57) ABSTRACT

A pump assembly and a high-pressure cleaning apparatus, the pump assembly includes a motor assembly, a motor housing for receiving the motor assembly, a transmission assembly driven by the motor assembly, a pump, and a pipe assembly connecting the motor housing and the pump. Mutually independent heat dissipation portions are provided at two sides of the motor housing.

7 Claims, 8 Drawing Sheets

(56) References Cited

FOREIGN PATENT DOCUMENTS

| | | | | | |
|---|---|---|---|---|---|
| CN | 110052342 | A | | 7/2019 | |
| CN | 110159549 | A | * | 8/2019 | ..... B08B 3/02 |
| CN | 110159549 | A | | 8/2019 | |

* cited by examiner

PUMP ASSEMBLY AND HIGH-PRESSURE CLEANING APPARATUS

CROSS-REFERENCE TO RELATED APPLICATIONS

This application is a US application which claims the priority of CN Application Serial No. 201911094808.X, filed on Nov. 11, 2019, the disclosures of which are hereby incorporated by reference in their entirety.

TECHNICAL FIELD

The invention relates to the technical field of cleaning apparatus, in particular to a high-pressure cleaning apparatus.

BACKGROUND ART

At present, there are two main ways for high-pressure cleaning apparatus on the market to dissipate heat, one way is to use a fan to cool the motor, and the other one is to use a water-cooling channel to cool the motor.

The fan cooling method is to set a ventilation groove structure on the machine, which has a low heat dissipating efficiency and a poor cooling effect. In addition, in the process of use, because the water is easy to enter the ventilation groove structure and the high-pressure cleaning apparatus has a low waterproof level, it will easily affect the operation and use safety of the electrical assembly inside the machine.

Therefore, the existing high-pressure cleaning apparatus mainly adopts the cooling method using the water-cooling channel. The cooling method adopting the water-cooling channel is to set an annular plunger cavity on the surface of the motor housing, which has a high heat dissipating efficiency and a good cooling effect. However, the structure of the annular plunger cavity is relatively complicated and large in size. The non-handheld high-pressure cleaning apparatus generally used cannot meet the requirement of the plunger cavity of the handheld high-pressure cleaning apparatus.

In view of this, it is indeed necessary to provide a high-pressure cleaning apparatus to solve the above problem.

SUMMARY OF INVENTION

The objective of the present invention is to provide a high-pressure cleaning apparatus with a small volume, a high efficiency, a good cooling effect and a convenience for carrying.

To achieve the above objective, the present invention adopts the following technical solutions: a pump assembly comprises a motor assembly, the motor assembly including a motor shaft, a motor housing, the motor assembly received in the motor housing, a transmission assembly driven by the motor assembly, a pump connected to the transmission assembly, and a pipe assembly connecting the motor housing and the pump, wherein at least two mutually independent heat dissipation portions are provided in the motor housing.

As a further improved technical solution of the present invention, the motor housing includes a first main body portion, two side cover plates and a front cover plate assembled to the first main body portion, and the transmission assembly is received in a transmission housing, the transmission housing includes a second main body portion and an upper cover plate, the first main body portion and the second main body portion being integrally set.

As a further improved technical solution of the present invention, grooves are provided on both sides of the first main body portion, and openings at the front and rear ends of the first main body portion and a receiving space for receiving the motor assembly, the two side cover plates are respectively assembled into two grooves to form the heat dissipating portion, and the front cover plate is assembled to the front opening of the first body portion away from the transmission assembly.

As a further improved technical solution of the present invention, a plurality of guide ribs are provided in the groove, and the plurality of guide ribs form a cooling water channel in the heat dissipating portion, and two ends of the heat dissipating water channel are located at two opposite corners of each side of the main body portion.

As a further improved technical solution of the present invention, the second body portion is provided with a receiving space for receiving the transmission assembly and three openings communicating with the receiving space, wherein two openings are respectively located at the front and rear ends of the second main body portion, the other opening is located at the top of the second main body portion, the opening at the front end of the second main body portion communicates with the opening at the rear end of the first main body portion, and the upper cover plate is used to close the opening at the top of the second main body portion.

As a further improved technical solution of the present invention, the transmission assembly comprises an integrated transmission shaft being perpendicular to the motor shaft of the motor assembly, an eccentric block sleeved on the transmission shaft and connected to the pump assembly, a small gear sleeved on the motor shaft, a large gear sleeved on the transmission shaft and connected to the small gear, and a bearing sleeved on the lower end of the transmission shaft under the large gear, the transmission shaft is rotatablely mounted to the transmission housing.

As a further improved technical solution of the present invention, the pipe assembly includes a water inlet pipe and a connecting pipe, and the motor housing is provided with a water inlet and a water outlet, the pump is provided with a pump inlet, the water inlet pipe is connected to the water inlet of the motor housing, and the connecting pipe is connected to the water outlet of the motor housing and the pump inlet of the pump.

As a further improved technical solution of the present invention, the pump includes a plunger connected to the transmission assembly and a plunger cavity for receiving the plunger, and the plunger includes a connecting portion connected to the transmission assembly, a main body portion and a head portion, and the plunger is provided with a plastic plug blocking the opening extending from the head to the main body portion, a first annular groove is located at a position of the main body near the head.

As a further improved technical solution of the present invention, the motor assembly is a brushless DC motor, the motor housing is a cuboid, and the transmission housing is cylindrical.

In order to achieve the above object, the present invention also provides a high-pressure cleaning apparatus comprises a switch assembly, a motor assembly, the motor assembly including a motor shaft, a motor housing, the motor assembly received in the motor housing, a transmission assembly driven by the motor assembly, a pump connected to the transmission assembly, a pipe assembly connecting the motor housing and the pump, wherein at least two mutually independent heat dissipation portions are provided in the motor housing.

As a further improved technical solution of the present invention, the switch assembly turns the motor assembly and the pipe assembly on simultaneously when pushed by hand.

As a further improved technical solution of the present invention, the switch assembly comprising a trigger, a water inlet switch is configured to control the opening and closing of the water, and an electric switch is configured to turn on or turn off the motor assembly.

As a further improved technical solution of the present invention, the water inlet switch comprises a water inlet valve and a driving rod, one end of the driving rod engages with the trigger and the other end engages with the water inlet valve for controlling the opening and closing of the water valve.

As a further improved technical solution of the present invention, the pipe assembly comprises water inlet pipe, the water inlet pipe includes a pipe body and a mounting pipe is perpendicular to the water inlet pipe, the water inlet valve is disposed in the water inlet pipe and comprised a valve seat and a valve core As a further improved technical solution of the present invention, the driving rod is received in the mounting pipe, one end of the driving rod is adjacent to the trigger and the other end is adjacent to the water inlet switch, a sealing ring and a spring are disposed on the driving rod.

As a further improved technical solution of the present invention, the valve seat comprises a first body portion and a first through hole disposed thereof, the valve core includes an ejector pin and a second main body portion, a second through hole are disposed on the second main body portion.

As a further improved technical solution of the present invention, an inclined surface is set in the distal end of the second through hole, one end of the driving rod engages with the inclined surface.

As a further improved technical solution of the present invention, the ejector pin engages with the valve seat tightly.

As a further improved technical solution of the present invention, the electric switch includes a switch body, a contact is disposed on the switch body, the electric switch is electrically connected to the motor assembly, the contact is depressed by the trigger to turn on the motor assembly.

As a further improved technical solution of the present invention, a receiving space is disposed on the trigger to receive one end of the driving rod.

The beneficial effect of the present invention is that the requirements of the handheld high-pressure cleaning apparatus are satisfied by arranging mutually independent heat dissipating portions on both sides of the motor housing. The high-pressure cleaning apparatus has a small in volume, a high efficiency, a good cooling effect, and a convenience for carrying.

DESCRIPTION OF EMBODIMENTS

Figure 1:
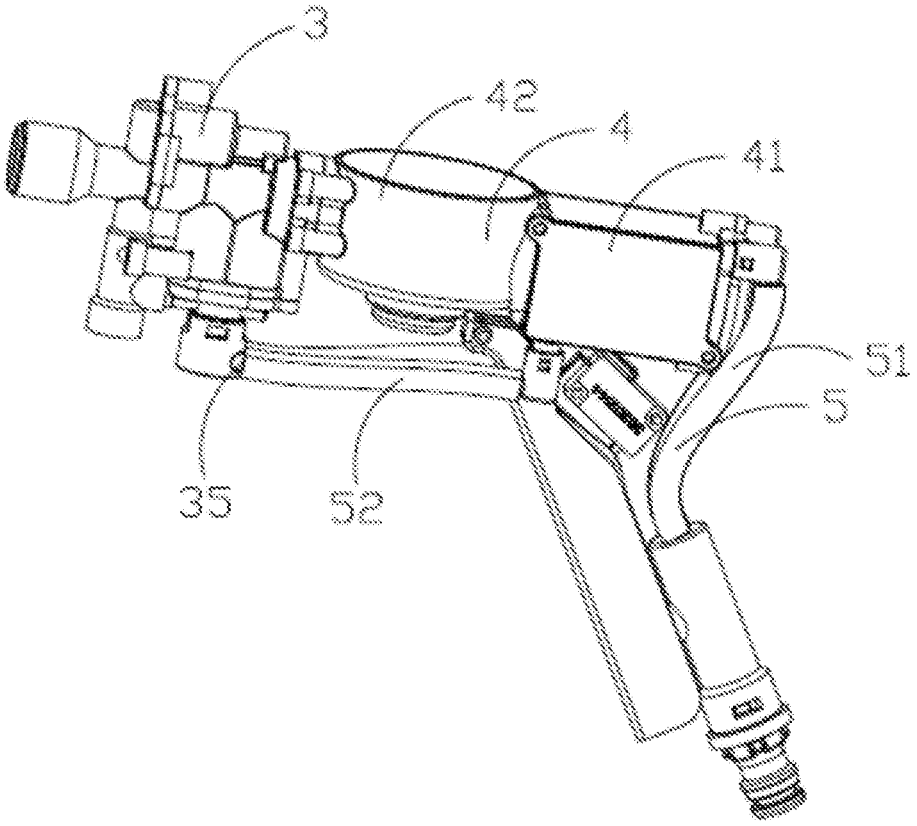
FIG. 1 is a perspective view of a high-pressure cleaning apparatus according to the present invention.

In order to make the objective, technical solutions, and advantages of the present invention clearer, the following describes the present invention in detail with reference to the accompanying drawings and specific embodiments.

As shown in FIG. 1 to FIG. 5, the high-pressure cleaning apparatus of the present invention includes a pump assembly and a switch assembly 6, the pump assembly includes a motor assembly 1, a transmission assembly 2 driven by the motor assembly 1, a pump 3 connected to the transmission assembly 2, a base 4, a pipe assembly 5.

Figure 5:
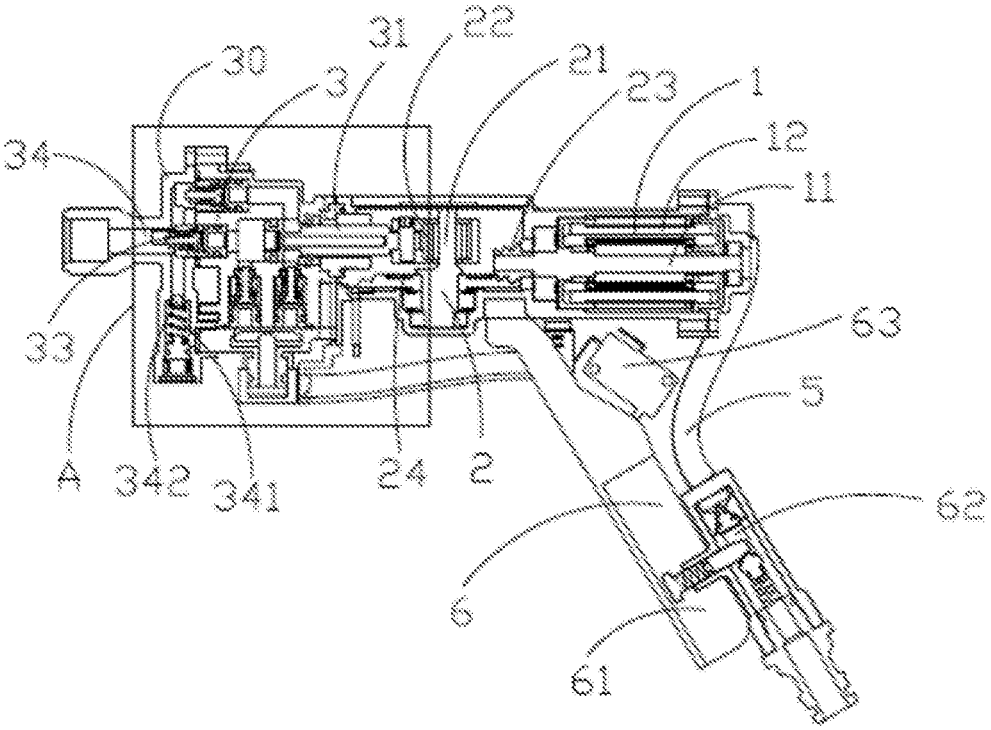
FIG. 5 is a sectional view of the high-pressure cleaning apparatus of the present invention.

As shown in FIG. 5, the motor assembly 1 includes a motor shaft 11 and a motor stator and rotor assembly 12. The motor assembly 1 is a DC brushless motor. On the one hand, the DC brushless motor optimizes the water cooling method of the stator and rotor assembly 12 of the motor while reducing the size of the motor. On the other hand, the DC brushless motor reduces resistance in the pipe assembly 5 while enhancing the cooling effect, thereby the suction force and the performance parameters of the pump 3 in a self-sucking state are improved.

Figure 2:
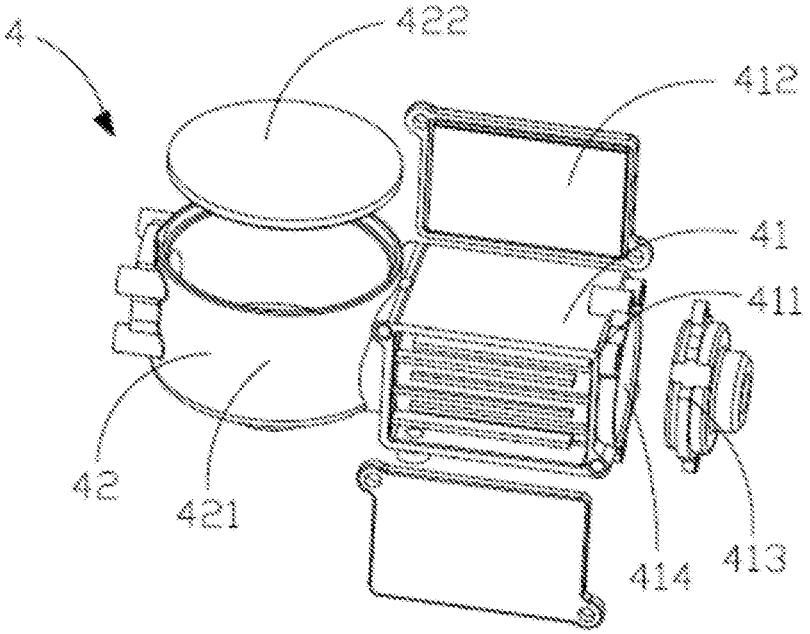
FIG. 2 is an exploded perspective view of the base of the present invention.
Figure 3:
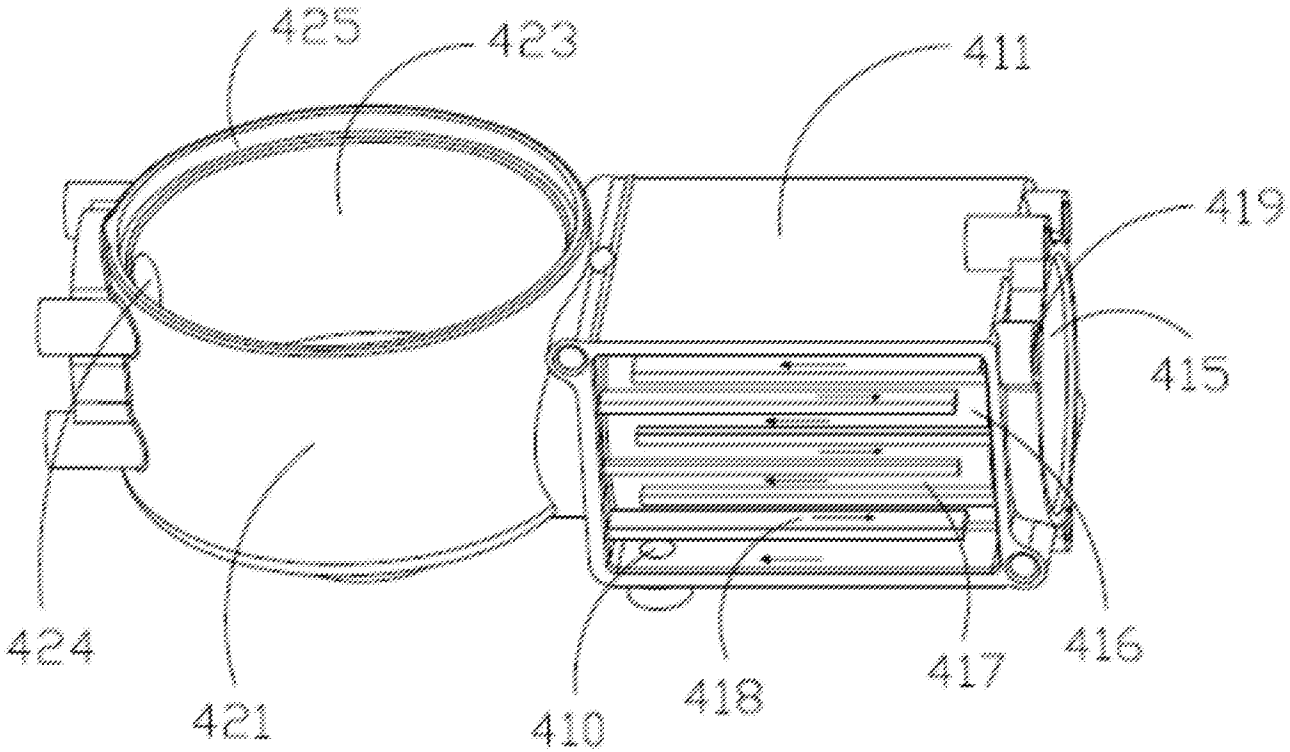
FIG. 3 is a perspective view of a first body portion and a second body portion of the present invention.

As shown in FIG. 2 and FIG. 3, the motor assembly is received in a motor housing 41 and the transmission assembly 2 is received in a transmission housing 42. The motor housing 41 is a cuboid shape, which includes a first main body portion 411, two side cover plates 412 and a front cover plate 413 assembled to the first body portion 411.

The first body portion 411 is provided with an opening 414 at the front end thereof, an opening (not labeled) at the rear end thereof, and a receiving space 415 for receiving the motor assembly 1. The first body portion 411 is assembled with the front cover plate 413 at the front end opening 414 far away from the transmission assembly 2, and the first body portion 411 is assembled with the transmission housing 42 at the rear end opening near the transmission assembly 2.

The first body portion 411 has grooves 416 on its both sides, and the two side cover plates 412 are respectively assembled to the two grooves 416 to form a heat dissipating portion 417. The heat dissipating portions 417 on both sides of the first main body portion 411 are simpler in structure and smaller in size than the general annular water channel, so that it is more convenient for the use of a handheld high-pressure cleaning apparatus. On the other hand, the heat dissipating portions 417 on both sides are independent to each other, which is easy to improve the cooling effect of each heat dissipating portion 417. In addition, the cooling method using water-cooling channel adopted by the heat sink 417 can make the high-pressure cleaning apparatus meet the IPX5 waterproof rating requirement compared with the fan cooling method, thereby increasing the working pressure of the high-pressure cleaning apparatus to 4 MPa.

In order to further improve the cooling effect of the heat dissipating portion 417, a plurality of flow guiding ribs 418 are provided in the groove 416. The plurality of flow guiding ribs 418 define a cooling water channel in the heat dissipating portion 417 (see the arrow in FIG. 3). The two ends of the water channel are respectively located at two opposite corners of each side of the main body portion 411, so that the water flow flows through the heat dissipating portion 417 in sequence from top to bottom under the guidance of the guide ribs 418, so that the two sides of the motor assembly 1 are uniformly cooled.

The transmission housing 42 is cylindrical and includes a second body portion 421 and an upper cover plate 422. The second body portion 421 is provided with a receiving space 423 for receiving the transmission assembly 2 and three openings communicating with the receiving space 423. Two of the openings are respectively located at the front end and the rear end of the second main body portion 421. Specifically, the opening (not labeled) at the front end of the second main body portion 421 communicates with the opening at the rear end of the first main body portion 411, and the opening 424 at the rear end of the second main body portion 421 is in communication with the pump 3. The other opening 425 is located on the bottom of the second body portion 421, and the upper cover plate 422 is used to close the opening 425.

The first main body portion 411 and the second main body portion 421 are integrally provided, thereby reducing the noise and the vibration caused by manufacturing and fitting errors between the motor assembly 1 and the transmission housing 42, improving the transmission accuracy and efficiency of the high-pressure cleaning apparatus, and reducing the useless power consumption of the machine.

Please refer to FIG. 1 and FIG. 3, the pipe assembly 5 includes water inlet pipe 51 and a connecting pipe 52, and a water inlet and a water outlet are all provided on the motor housing 41, the pump 3 has a pump inlet 35. The water inlet 419 and the water outlet 410 on the motor housing 41 are respectively located at two ends of the heat dissipating water channel, and the water inlet pipe 51 is divided into two pipes respectively connected to the water inlets 419 of the heat dissipating water channels on both sides of the motor housing 41. One end of the connecting pipe 52 is connected to the water outlet 410 of the heat dissipating water channel on both sides of the motor housing 41, and the other end is connected to the pump inlet 35 of the pump 3.

Figure 8:
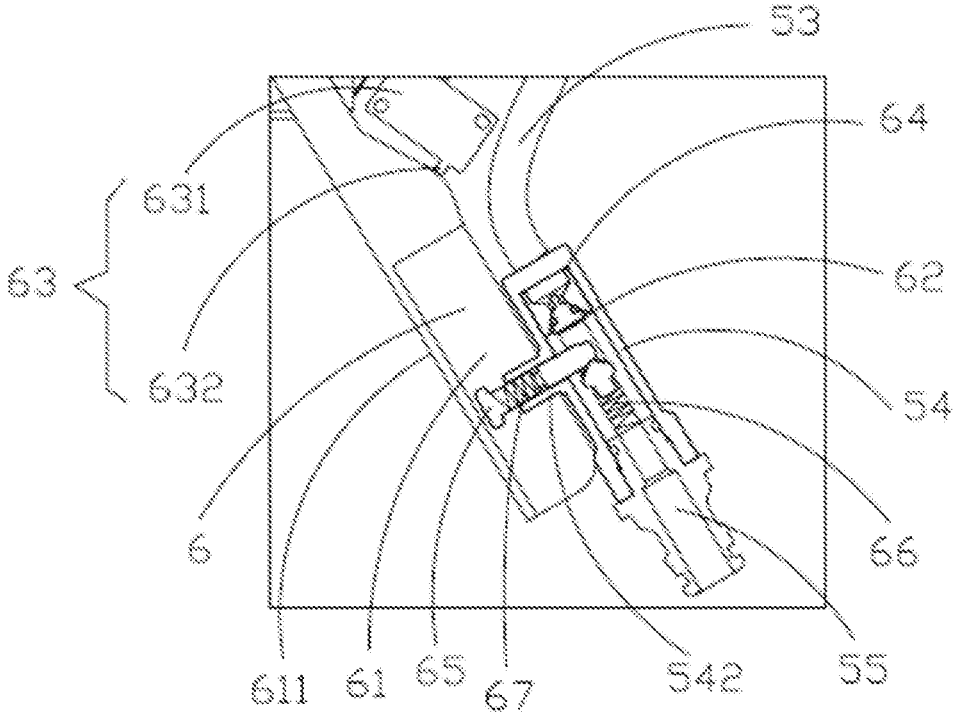
FIG. 8 is a partially enlarged view of the water inlet switch in FIG. 5.
Figure 9:
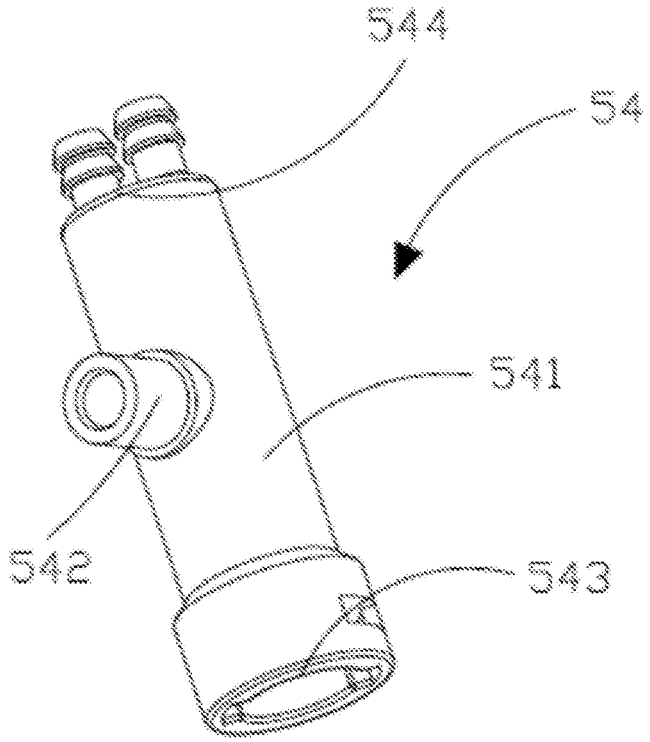
FIG. 9 is an exploded perspective view of a water inlet pipe of the present invention.

As shown in FIGS. 8 and 9, the water inlet pipe 51 includes a connecting pipe 53, a water inlet pipe 54, and a water inlet seat 55 connected in turn. The water inlet pipe 54 includes a pipe body 541, a mounting pipe 542 which is perpendicular to the pipe body 541 and communicates with the pipe body 541, and a water inlet end 543 and a water outlet end 544 located at both ends of the pipe body 541. The water inlet seat 55 connects with the water inlet end 543, and the connecting pipe 53 is connected to the water outlet end 544.

Figure 4:
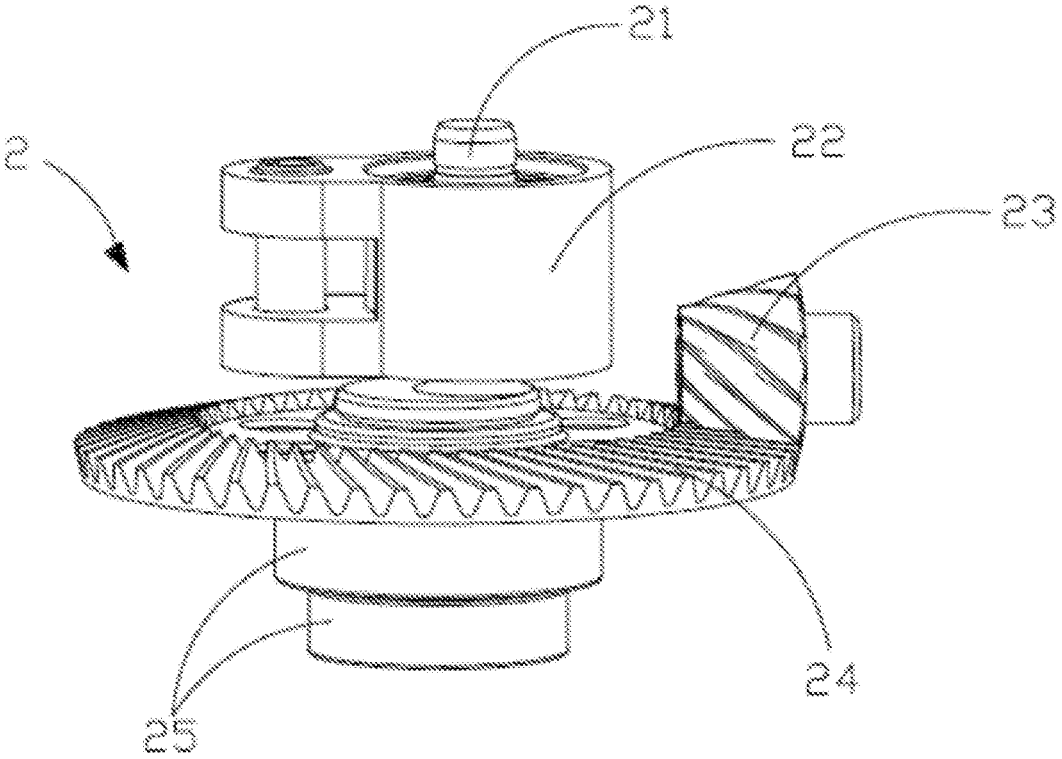
FIG. 4 is a perspective view of a transmission assembly according to the present invention.

Please refer to FIG. 4 and FIG. 5, the transmission assembly 2 includes an integrated transmission shaft 21 perpendicular to the motor shaft 11 of the motor assembly 1, an eccentric block 22 sleeved on the transmission shaft 21 and connected to the pump 3, a small gear 23 sleeved on the motor shaft 11, a large gear 24 sleeved on the transmission shaft 21 and engaged with the small gear 23, and a bearing 25 located below the large gear 24 and sleeved on the transmission shaft 21. The high-pressure cleaning apparatus mainly adopts the bearing 25 to support the transmission shaft 21 for transmission, which avoids the machine vibration and noise generated by the fit clearance caused by the need to split the transmission shaft 21 into two sections when designing support at both ends of the transmission shaft 21, and also reduces the manufacturing accuracy and cost of the assembly.

Figure 6:
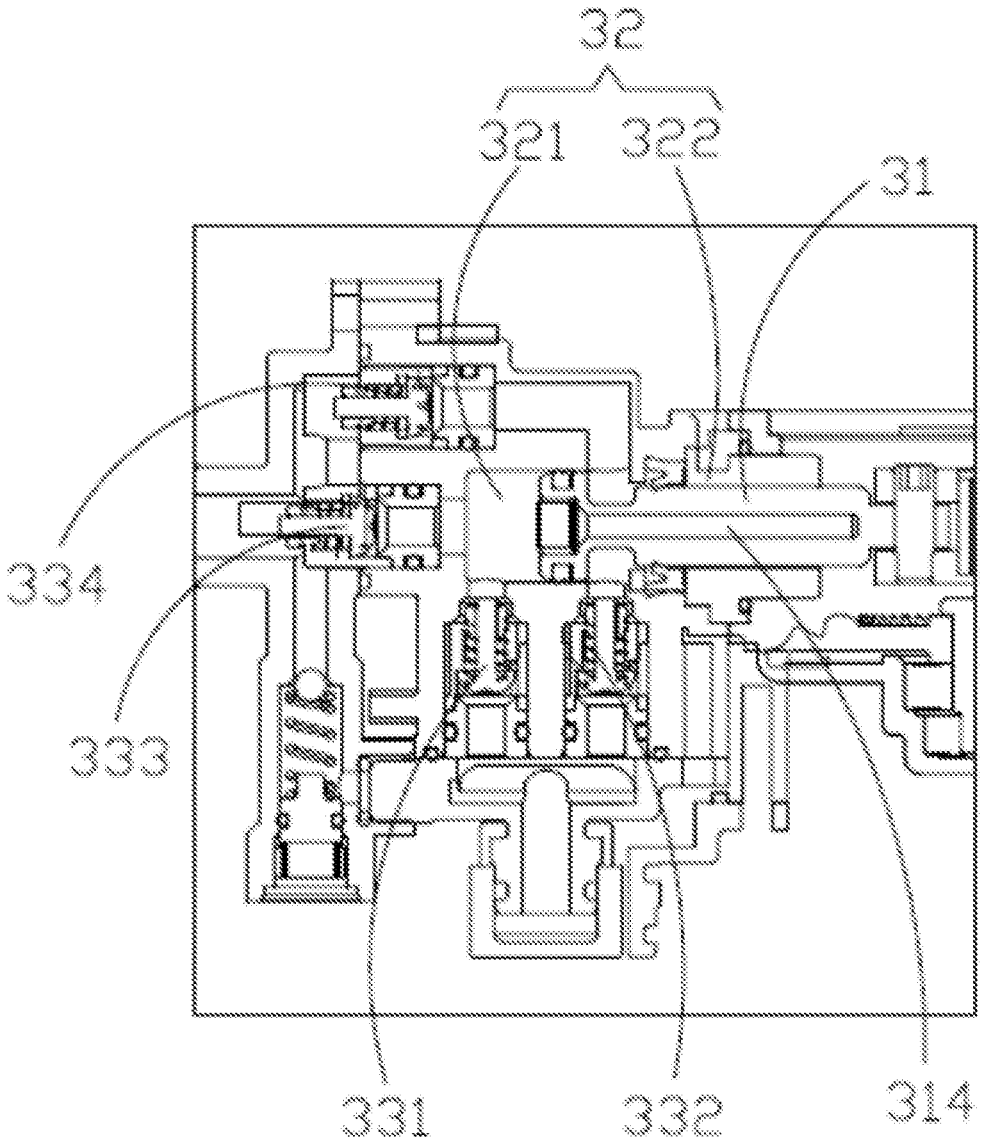
FIG. 6 is an enlarged view of a part A in FIG. 5.

Refer to FIG. 5 and FIG. 6, the pump 3 is a single-plunger, which includes a pump housing 30, a plunger 31 located inside the pump housing 30 and connected to the transmission assembly 2, a plunger cavity 32 for receiving the plunger 31, four check valves 33 and a water outlet body 34. The transmission assembly 2 drives the plunger 31 to reciprocate to pressurize the liquid in the plunger cavity 32, and the pressurized liquid flows out through the water outlet body 34.

Figure 7:
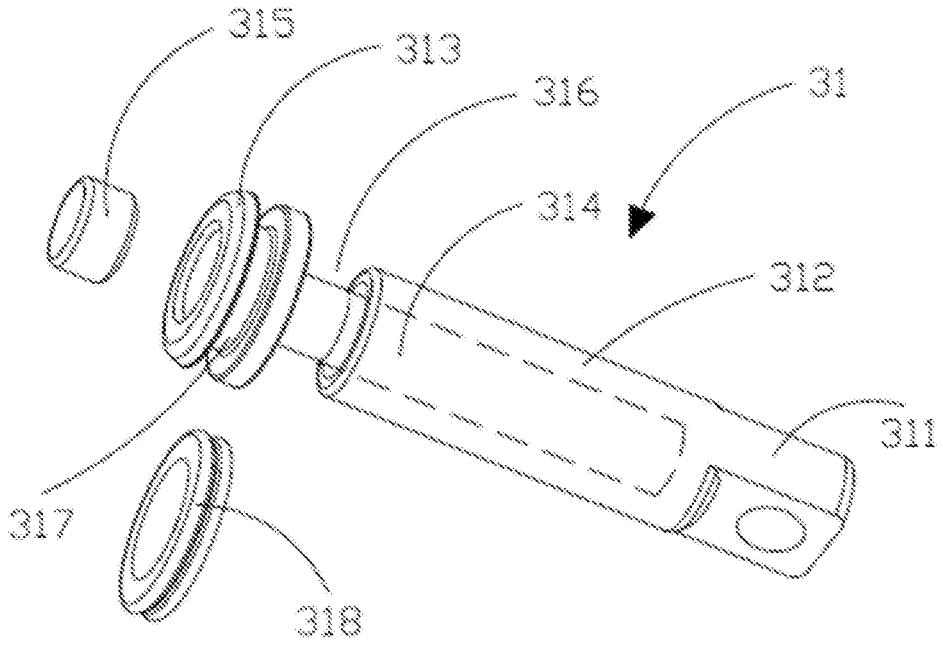
FIG. 7 is an exploded perspective view of a plunger of the present invention.

As shown in FIG. 7, the plunger 31 includes a connecting portion 311 connected to the transmission assembly 2, a main body portion 312, and a head portion 313. The head 313 of the plunger 31 divides the plunger cavity 32 into a first cavity 321 and a second cavity 322. The second cavity 322 is close to the transmission assembly 2.

The plunger 31 is provided with an opening 314 extending from the head portion 313 to the main body portion 312, which is mainly used to reduce the weight of the plunger 31, thereby reducing the vibration caused by the impact of the plunger 31 on the pump 3 during reciprocating motion. The head portion 313 of the plunger 31 is also provided with a plastic plug 315 that blocks the opening 314, which can not only reduce the mass of the plunger 31, but also reduce the clearance volume of the plunger cavity 32 after compression, thereby improving the working efficiency of the high-pressure cleaning apparatus. A first annular groove 316 is provided at a position of the main body portion 312 of the plunger 31 near the head portion 313, which is mainly used to increase the water inflow and drainage of the second chamber 322, thereby increasing the water flow of the high-pressure cleaning apparatus. The head portion 313 of the plunger 31 is provided with a second annular groove 317, and a water seal 318 is sleeved on the second annular groove 317.

The four check valves 33 include a first water inlet valve 331, a second water inlet valve 332, and a first water outlet valve 333 and a second water outlet valve 334. The first water inlet valve 331 and the second water inlet valve 332 are located below the plunger 31 and perpendicular to the plunger 31. The first water outlet valve 333 and the second water outlet valve 334 are parallel to the plunger 31. At the same time, the first water inlet valve 331 and the second water inlet valve 332 are connected to the connecting pipe 52 of the pipe assembly 5, and the first water outlet valve 333 and the second water outlet valve 334 are connected to the water outlet body 34.

A safety valve 341 is installed on the water outlet body 34. When the pump 3 is in operation and the water outlet nozzle (not shown) connected to the water outlet body 34 is blocked, the water pressure in the water outlet body 34 will immediately rise, and the water pressure will immediately reacts on the first water outlet valve 333 and the second water outlet valve 334, and the first water outlet valve 333 and the second water outlet valve 334 are closed. Simultaneously the water pressure acts on the safety valve 341 below the water outlet body 34. The valve core 342 of the safety valve 341 will be opened immediately under the effect of the return water pressure, and the high-pressure return water will be depressurized into the pipe assembly 5. After the water pressure is released, the valve core 342 of the safety valve will immediately return to the closed state. In this way, when the nozzle is blocked, damage to the water gun (not shown) connected to the pump 3 can be avoided.

The working process of the pump 3 is specifically below:

Please refer to FIG. 6, when the plunger 31 moves to the left, the water in the left first chamber 321 is compressed to form a high pressure. The first water inlet valve 331 is closed and the first water outlet valve 333 is opened, so that the high pressure water enters the water outlet body 34 through the first water outlet valve 333. At the same time, the second chamber 322 on the right forms a vacuum state, and the second water inlet valve 332 is opened and the second water outlet valve 334 is closed, so that an external water enters the second chamber 322 through the second water inlet valve 332.

When the plunger 31 moves to the right, the water in the right second chamber 322 is compressed to form a high pressure. The second water inlet valve 332 is closed and the second water outlet valve 334 is opened, so that the high pressure water enters the water outlet body 34 through the second water outlet valve 334. At the same time, the first chamber 321 on the left forms a vacuum state, and the first water inlet valve 331 is opened and the first water outlet valve 333 is closed, so that an external water enters the first chamber 321 through the first water inlet valve 331.

Please refer to FIG. 8, the switch assembly 6 includes a trigger 61, a water inlet switch 62 and an electric switch 63. The trigger 61 controls the water inlet switch 62 and the electric switch 63 in conjunction, thereby realizing the water-electricity linkage control function of the handheld high-pressure cleaning apparatus.

Figure 10:
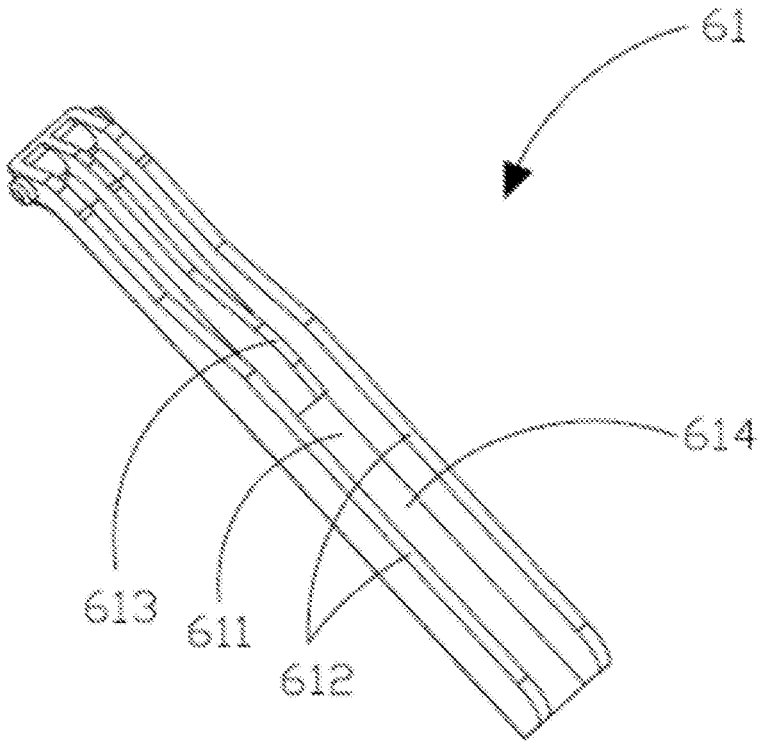
FIG. 10 is a perspective view of a trigger of the present invention.

As shown in FIG. 10, the trigger 61 includes a bottom wall 611, two side walls 612 located on both sides of the bottom wall 611, and an intermediate wall 613 located between the two side walls 612. The bottom wall 611 and the two side walls 612 form a receiving groove 614. After assembly, the mounting pipe 542 is received in the receiving groove 614, so that the water inlet pipe 54 and the trigger 61 are connected together.

Figure 11:
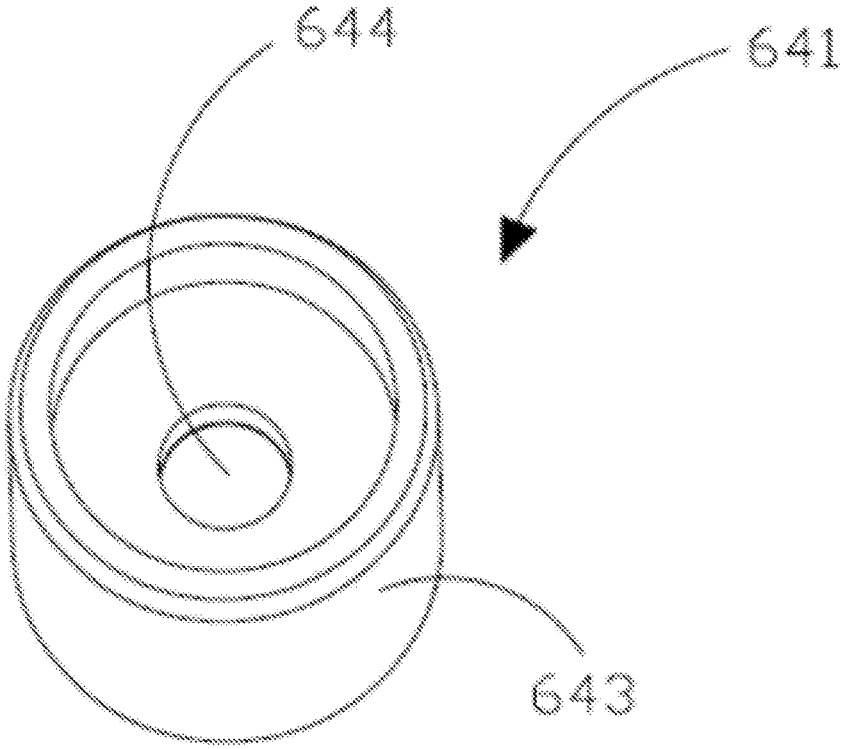
FIG. 11 is a perspective view of a valve seat of the present invention.

As shown in FIG. 8 and FIG. 11, the water inlet switch 62 includes a water inlet valve 64 and a driving rod 65, which are mainly used to control the opening and closing of the pipe assembly 5. The water inlet valve 64 is installed in the water inlet pipe 54 and includes a valve seat 641 and a valve core 642 matched with the valve seat 641. The valve seat 641 is located near to the water outlet end 544 and includes a first body portion 643 and a first through hole 644 set in the first body portion 643.

Figure 12:
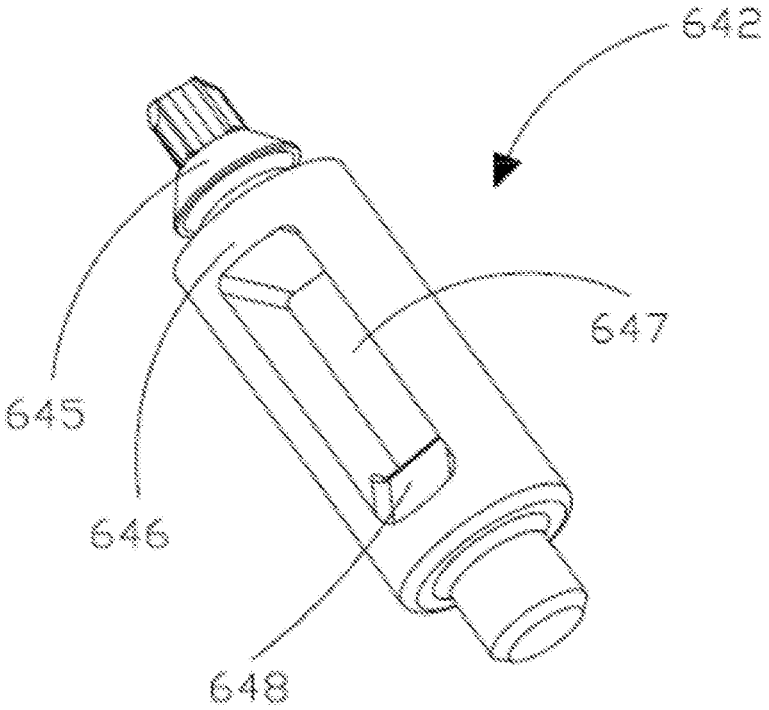
FIG. 12 is a perspective view of a valve core of the present invention.

As shown in FIGS. 8 and 12, the valve core 642 includes a ejector pin 645, a second main body portion 646, and a second through hole 647 defined in the second main body portion 646. The ejector pin 645 of the valve core 642 closely cooperates with the first through hole 644 of the valve seat 641. When the water inlet switch 62 is turned off, the ejector pin 645 of the valve core 642 is tightly plugged in the first through hole 644, thereby preventing water flow through the water inlet pipe 54. When the water inlet switch 62 is turned on, the ejector pin 645 of the valve core 642 is disengaged from the first through hole 644, thereby allowing water flow to the connecting pipe 53 through the water inlet pipe 54. In addition, a spring 66 is provided between the second body portion 646 and the water inlet seat 55, and a bottom surface of the second through hole 647 away from the valve seat 641 is provided with an inclined protruding-upward surface 648.

Figure 13:
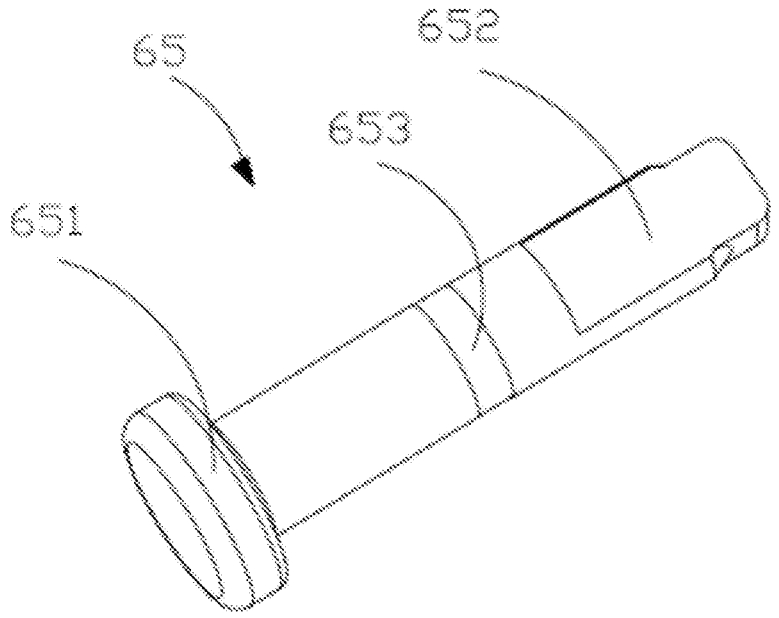
FIG. 13 is a perspective view of a driving rod of the present invention.

Please refer to FIG. 8 and FIG. 13, the driving rod 65 is an integrated structure and is received in the mounting pipe 542. One end of the driving rod 65 is matched with the trigger 61 and the other end is matched with the water inlet valve 64 to control the opening and closing of the water inlet valve 64. The driving rod 65 includes a head portion 651 abutting on the bottom wall 611 of the trigger 61 and a rod portion 652 abutting against the inclined surface 648 of the valve core 642. In addition, a sealing ring 653 is provided on the rod portion 652 to prevent water from leaking out through the mounting pipe 542. A spring 67 is provided on the rod portion 652.

As shown in FIG. 8, the electric switch 63 includes a switch body 631 and a contact 632 provided on the switch body 631, which is mainly used to control the motor assembly 1 to open and close. The electric switch 63 is electrically connected to the motor assembly 1, and the contact 632 is disposed adjacent to the intermediate wall 613. The contact 632 is pressed by the trigger 61, so that the electric switch 63 starts the motor assembly 1. The structure of the electric switch 63 in the present invention is the prior art, and is not repeated here.

The working process of the switch assembly 6 is specifically shown below:

When the trigger 61 is pressed to start the high-pressure cleaning apparatus, on the one hand, the intermediate wall 613 of the trigger 61 presses the contact 632 to start the motor assembly 1, on the other hand, the bottom wall 611 of the trigger 61 presses the head portion 651 of the driving rod 65. At the same time, the rod portion 652 of the driving rod 65 is pushed to move to the inclined surface 648, so that the ejector pin 645 of the valve core 642 is slowly separated from the first through hole 644 of the valve seat 641, and the water flows into the connecting pipe 53 through the water inlet pipe 54. When the trigger 61 is released to turn off the high-pressure cleaning apparatus, on the one hand, the contact 632 returns and cuts off the power, and the electric switch 63 is turned off. On the other hand, the driving rod 65 returns to its original position under the action of the spring 67, and the valve core 642 is also reinserted into the first through hole 644 under the action of the spring 66.

The working process of the high pressure cleaning apparatus is specifically shown below:

First, the small gear 23 in the transmission housing 41 is driven by the motor shaft 11 to rotate, the small gear 23 drives the large gear 24 to rotate, and the large gear 24 drives the transmission shaft 21 to rotate. The plunger 31 performs a reciprocating motion driven by the eccentric block, thereby converting the rotation of the motor shaft 11 into a linear motion of the plunger 31. Then, the four check valves 33 provided inside the pump 3 are driven by the reciprocating motion of the plunger 31 to suck water and pressurize water. Finally, a high pressure output of high-pressure cleaning apparatus water flow is achieved.

In summary, the present invention provides a high-pressure cleaning apparatus, which includes a motor assembly 1, a transmission assembly driven by the motor assembly 1, a pump 3 connected to the transmission assembly 2, a base 4, and a pipe assembly 5. The high-pressure cleaning apparatus meets the requirements of heat dissipation by providing independent heat-dissipating portions 417 on both sides of the motor housing 41. The high-pressure cleaning apparatus is small in size, high in efficiency, good in cooling, and easy to carry.

Terms such as "upper", "lower", "left", "right", "front", "rear", and the like indicating spatial relative positions are described for convenience of description as shown in the accompanying drawings The relationship of one feature to another. It can be understood that, according to different product placement positions, the terms of spatial relative positions may be intended to include different positions other than the positions shown in the drawings, and should not be construed as limiting the claims. In addition, the descriptive word "horizontal" used herein is not completely equivalent to allowing a certain angle of inclination along the direction perpendicular to gravity.

In addition, the above embodiments are only used to illustrate the present invention and not to limit the technical solutions described in the present invention. The understanding of the present specification should be based on those skilled in the art, although the present invention has been carried out with reference to the above embodiments. Detailed description, however, it should be understood by those skilled in the art that those skilled in the art can still modify or equivalently replace the present invention, and all technical solutions and improvements without departing from the spirit and scope of the present invention should be It is encompassed within the scope of the claims of the present invention.

What is claimed is:

1. A pump assembly comprising:

a motor assembly, the motor assembly including a motor shaft;

a motor housing, the motor assembly received in the motor housing;

a transmission assembly driven by the motor assembly;

a pump connected to the transmission assembly; and a pipe assembly connecting the motor housing and the pump; wherein at least two mutually independent heat dissipation portions are provided in the motor housing;

wherein the transmission assembly comprises an integrated transmission shaft being perpendicular to the motor shaft of the motor assembly, an eccentric block sleeved on the transmission shaft and connected to the pump assembly, a small gear sleeved on the motor shaft, a large gear sleeved on the transmission shaft and connected to the small gear, and a bearing sleeved on a lower end of the transmission shaft under the large gear, the transmission shaft is rotatably mounted to a transmission housing;

wherein the motor housing includes a first main body portion, two side cover plates and a front cover plate assembled to the first main body portion, and the transmission assembly is received in the transmission housing, the transmission housing includes a second main body portion and an upper cover plate, the first main body portion and the second main body portion being firmly attached to one another.

2. The pump assembly according to claim 1, wherein grooves are provided on both sides of the first main body portion, openings are provided at the front and rear ends of the first main body portion to form a receiving space for receiving the motor assembly, each of the two side cover plates is assembled to a corresponding groove to form a corresponding heat dissipating portion, and the front cover plate is assembled to the opening provided at the front end of the first main body portion away from the transmission assembly.

3. The pump assembly according to claim 1, wherein the second main body portion is provided with a receiving space for receiving the transmission assembly and three openings communicating with the receiving space, wherein two openings of the three openings are respectively located at the front and rear ends of the second main body portion, another opening of the three openings is located at the top of the second main body portion, the opening at the front end of the second main body portion communicates with the opening at the rear end of the first main body portion, and the upper cover plate is used to close the opening at the top of the second main body portion.

4. The pump assembly according to claim 1, wherein the pipe assembly includes a water inlet pipe and a connecting pipe, and the motor housing is provided with a water inlet and a water outlet, the pump is provided with a pump inlet, the water inlet pipe is connected to the water inlet of the motor housing, and the connecting pipe is connected to the water outlet of the motor housing and the pump inlet of the pump.

5. The pump assembly according to claim 1, wherein the pump includes a plunger connected to the transmission assembly and a plunger cavity for receiving the plunger, and the plunger includes a connecting portion connected to the transmission assembly, a main body portion and a head portion, and the plunger is provided with a plastic plug blocking an opening extending from the head to the main body portion, a first annular groove is located at a position of the main body near the head.

6. The pump assembly according to claim 1, wherein the motor assembly is a brushless DC motor, the motor housing is a cuboid, and the transmission housing is cylindrical.

7. A pump assembly comprising:

a motor assembly, the motor assembly including a motor shaft;

a motor housing, the motor assembly received in the motor housing;

a transmission assembly driven by the motor assembly;

a pump connected to the transmission assembly; and a pipe assembly connecting the motor housing and the pump; wherein at least two mutually independent heat dissipation portions are provided in the motor housing;

wherein the motor housing includes a first main body portion, two side cover plates and a front cover plate assembled to the first main body portion, and the transmission assembly is received in a transmission housing, the transmission housing includes a second main body portion and an upper cover plate, the first main body portion and the second main body portion being firmly attached to one another;

wherein grooves are provided on both sides of the first main body portion, openings are provided at the front and rear ends of the first main body portion to form a receiving space for receiving the motor assembly, each of the two side cover plates is assembled to a corresponding groove to form a corresponding heat dissipating portion, and the front cover plate is assembled to the opening provided at the front end of the first main body portion away from the transmission assembly; and wherein a plurality of guide ribs form each groove, wherein each groove forms a cooling water channel in a corresponding heat dissipating portion, and two ends of each cooling water channel are located at two opposite corners of a corresponding side of the first main body portion.

* * * * *